US012753608B2

(12) United States Patent
Axt et al.

(10) Patent No.: US 12,753,608 B2
(45) Date of Patent: Oct. 6, 2026

(54) METHOD FOR CONNECTING AN EDGE METAL FLASHING ON A ROOFING MEMBRANE

(71) Applicant: SIKA TECHNOLOGY AG, Baar (CH)

(72) Inventors: David Axt, Goldendale, WA (US); Kelly Linhares-Nelson, Taunton, MA (US); Xiong Jiang, Canton, MA (US)

(73) Assignee: SIKA TECHNOLOGY AG, Baar (CH)

( * ) Notice: Subject to any disclaimer, the term of this patent is extended or adjusted under 35 U.S.C. 154(b) by 159 days.

(21) Appl. No.: 18/582,296

(22) Filed: Feb. 20, 2024

(65) Prior Publication Data

US 2025/0263930 A1 Aug. 21, 2025

(51) Int. Cl.
*E04D 13/15* (2006.01)
*E04D 7/00* (2006.01)

(52) U.S. Cl.
CPC ..... *E04D 13/15* (2013.01); *E04D 7/00* (2013.01)

(58) Field of Classification Search
CPC .. E04D 5/14; E04D 5/148; E04D 7/00; E04D 13/1415; E04D 13/15; E04D 13/155; E04D 11/002; E04D 11/02
USPC ..... 52/58, 408, 409, 411
See application file for complete search history.

(56) References Cited

U.S. PATENT DOCUMENTS 2,041,929 A * 5/1936 Hitzman ..... E04D 13/15 52/24
3,086,324 A * 4/1963 Cheney ..... E04D 13/15 52/96
3,432,976 A * 3/1969 Berg ..... E04D 13/15 52/60
3,668,811 A * 6/1972 Pollard ..... E04D 13/15 52/60
3,958,373 A * 5/1976 Stewart ..... E04D 13/1643 52/273
4,063,395 A * 12/1977 Stewart ..... E04D 3/351 220/900
4,282,697 A * 8/1981 Spielau ..... E04D 3/38 52/309.4
4,557,081 A * 12/1985 Kelly ..... E04D 13/17 52/406.3
4,870,796 A * 10/1989 Hart ..... E04D 11/02 52/409

(Continued)

*Primary Examiner* — James M Ference
(74) *Attorney, Agent, or Firm* — Oliff PLC

(57) ABSTRACT

A method for connecting an edge metal flashing to a roofing membrane, the method including the steps of: providing a roof assembly including a roof substrate, an edge metal flashing, and a roofing membrane, wherein a portion of the roofing membrane is trapped between the flashing and substrate and wherein the membrane is a water impermeable liquid applied membrane; applying a reactive adhesive layer to a portion of an upper major surface of the flashing; applying an epoxy resin layer on top of the reactive adhesive layer; and applying a water impermeable liquid applied membrane on top of the epoxy resin layer so that the applied water impermeable liquid applied membrane also covers a part of the water impermeable liquid applied membrane. The method provides an edge metal flashing connection system which is easy to apply and provides the required long-term watertightness.

7 Claims, 1 Drawing Sheet

(56) References Cited

U.S. PATENT DOCUMENTS 5,065,553 A * 11/1991 Magid ..... E04D 13/1407 52/60
5,586,414 A * 12/1996 Tawzer ..... E04D 5/14 52/96
5,605,020 A * 2/1997 Chambers ..... E04D 13/155 52/60
6,442,904 B1 * 9/2002 Ortiz ..... E04D 13/155 52/60
6,460,304 B1 * 10/2002 Kim ..... E04D 5/12 52/746.1
6,525,262 B1 * 2/2003 Makita ..... H02S 20/23 126/621
8,176,688 B1 * 5/2012 Smith ..... E04B 1/7046 52/60
8,539,719 B2 * 9/2013 McPheeters ..... F24S 25/636 52/27
11,214,956 B2 * 1/2022 Chich ..... E04D 7/00
11,332,937 B1 * 5/2022 Zheng ..... B29C 44/022
2005/0016084 A1 * 1/2005 Kraft ..... E04D 13/155 52/90.1
2007/0119105 A1 * 5/2007 MacDonald ..... E04F 13/0889 52/235
2008/0217947 A1 * 9/2008 Merryman ..... E04D 5/10 296/39.1
2009/0226740 A1 * 9/2009 Teysseire ..... C08G 18/10 524/262
2010/0119820 A1 * 5/2010 Ultsch ..... C08J 7/043 528/65
2011/0056620 A1 * 3/2011 Barksdale ..... B32B 27/08 156/247
2014/0134373 A1 * 5/2014 Kalwara ..... B32B 27/302 156/263
2016/0010336 A1 * 1/2016 Kelly ..... E04D 11/02 52/745.06
2017/0292050 A1 * 10/2017 Burckhardt ..... C08K 5/548
2020/0354584 A1 * 11/2020 Häberle ..... C08G 65/336
2021/0332181 A1 * 10/2021 Kasemi ..... C08G 59/5033
2022/0056696 A1 * 2/2022 Miller ..... E04D 5/10
2022/0098866 A1 * 3/2022 Yang ..... B32B 27/302
2022/0268027 A1 * 8/2022 Miller ..... D06N 3/186
2022/0275646 A1 * 9/2022 Jiang ..... B32B 7/12
2022/0332969 A1 * 10/2022 Iyer ..... C09D 5/185
2022/0389717 A1 * 12/2022 Rufus ..... B32B 15/08
2023/0416561 A1 * 12/2023 Barratt ..... C09D 175/08
2024/0254773 A1 * 8/2024 Jiang ..... E04D 13/155
2025/0043575 A1 * 2/2025 Padwal ..... E04D 5/10
2025/0263930 A1 * 8/2025 Axt ..... E04D 7/00

* cited by examiner

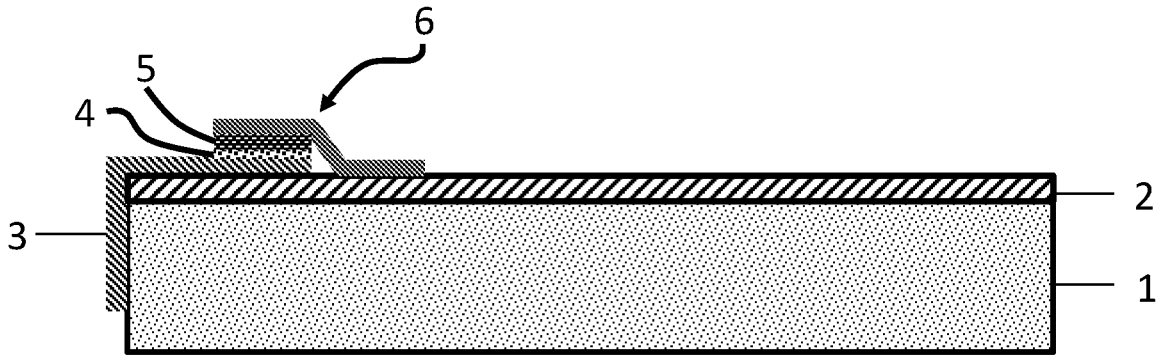
6
5
4
3
2
1

METHOD FOR CONNECTING AN EDGE METAL FLASHING ON A ROOFING MEMBRANE

TECHNICAL FIELD

The invention relates to the field of roof assemblies used in the field of construction. Particularly, the invention relates to a method for connecting an edge metal flashing to a roofing membrane using a water impermeable liquid applied membrane.

BACKGROUND OF THE INVENTION

Outer exterior surfaces of buildings must be protected from environmental forces such as wind and rain. Roofing membranes composed of polymeric materials are used for waterproofing of flat or slightly sloped roofs whereas sloped roofs are typically covered with roof shingles. Commonly used materials for the roofing membranes include plastics, in particular thermoplastics such as plasticized polyvinylchloride (p-PVC), thermoplastic olefins (TPE-O, TPO), elastomers such as ethylene-propylene diene monomer (EPDM) as well as water impermeable liquid applied membranes.

Liquid-applied waterproofing membranes are known. In roofing applications they are used as an alternative to prefabricated sheet membranes, offering easier application especially in the case of complex roof geometries and for refurbishment tasks, providing a flexible seamless roof coating which is fully adhered to the substrate. State-of-the-art liquid-applied waterproofing membranes are often reactive polyurethane compositions, formulated as one-part or as two-part systems, also called single-component or two-component systems, respectively.

Low-slope roof assemblies are typically composed of a roofing membrane, a rigid insulation and/or cover board, and a roof deck. The roofing membrane can be applied directly on the top of the insulation board, which is used to improve the thermal insulation properties of the roof assembly. Alternatively, the roofing membrane can be secured to a cover board, which is applied on top of the insulation board. In ventilated and cold roof designs, the insulation board can also be located below the roof deck.

Roofing membranes must be securely fastened to the roof substrate to provide sufficient mechanical strength to resist the shearing forces applied on it due to high wind loads. In a mechanically attached roof system, the roofing membrane is fastened to the roof substrate by using screws and/or barbed plates. In fully adhered roof systems, the roofing membrane is adhered to the roof substrate indirectly by using an adhesive composition, such as a solvent- or water-based contact adhesive. In ballasted roof systems, the roofing membrane is not anchored or adhesively adhered to the roof substrate but "ballasted" with a stone material, typically gravel. Mechanical fastening enables high strength bonding, but it provides direct attachment to the roof substrate only at locations where a mechanical fastener affixes the membrane to the surface, which makes mechanically attached membranes susceptible to flutter.

To create a continuous waterproofing seal on the surface of a roof substrate, the edges of adjacent membrane sheets are overlapped to form sealable joints. The joints can then be sealed by bonding the opposing surfaces of the edge portions to each other by using an adhesive ("bonded seams") or by heat-welding ("welded seams"). In addition, the outer edges of the membrane sheets adjacent to the roof edge, as well as edges of the membrane surrounding objects on the roof surface, must be sealed to ensure watertightness of the roof assembly. Cover strips composed of thermoplastic or thermoset materials, which are also known as "flashings", are commonly used for sealing the edges of roofing membranes. Thermoplastic flashings are typically made of materials that enable bonding to roofing membranes by heat-welding. Thermoset flashings are adhered to roofing membranes and other surfaces via pre-applied adhesive layer or by using adhesive agents that are applied at the construction site.

Metal edge flashings, such as drip edge and gravel stop flashings, are used to terminate the roof, and prevent water infiltration. These types of flashings typically direct water away from the roof edge either into a gutter, onto a water-impermeable surface below, or to the ground. A cover strip used for sealing a joint formed between a metal flashing and a roofing membrane must provide a watertight connection, whose long-term durability corresponds to that of the full roof, which is designed for several decades of service. One way to ensure watertightness of the connection is to provide the metal flashing with a polymeric coating that enables bonding of the cover strip to the metal flashing by heat-welding. Polymer coated metal flashings are commercially available, for example, under the trade name of Sarnaclad (from Sika Corporation). Such metal flashings are, however, only available in limited colors and sizes.

EP 3418466 B1 discloses use of a self-adhering cover strip intended to connect a metal edge flashing to a PVC roofing membrane. The cover strip comprises an outer PVC layer, a barrier layer covering a bottom surface of the outer PVC layer to prevent migration of plasticizers, a primer layer covering the barrier layer, and a layer of pressure sensitive adhesive applied on the primer coating. Furthermore, the cover strip is not directly bonded to the roofing membrane, but the surface of membrane is first coated with a strip barrier layer, which is then covered with a second primer layer. The barrier and primer layers are applied as wet films, which are cured by allowing the liquid to evaporate.

Although the system disclosed in EP 3418466 B1 solves the problem of connecting a thermoplastic cover strip to a metal edge flashing, it has several substantial drawbacks. First, two solvent-based primer compositions are applied, and a full evaporation of the wet films is required in each process step. Besides negative effect on the environment and worker safety resulting from VOC emissions, such process is also very sensitive towards applicator errors, particularly if the conditions on a construction site with large temperature variations (summer/winter, morning/afternoon) and humidity, are considered. Secondly, the primer must not be applied on the metal, but only to the roofing membrane, which is an additional source for application errors. Thus, the suggested system is suitable for a controlled environment and highly skilled workforce but does not provide the application safety and robustness required in a typical construction site. Finally, the primer application for the cover strip joints is very time consuming and thus expensive.

It is thus highly desirable to have a connection system which is easy to apply and provides the required long-term watertightness.

SUMMARY OF THE INVENTION

The object of the present invention is to provide an edge metal flashing connection system which is easy to apply and provides the required long-term watertightness.

The subject of the present invention is a method for connecting an edge metal flashing to a roofing membrane as defined in claim 1.

It was surprisingly found out that the disadvantages related to the prior art solutions can be solved or at least partially mitigated by using said method. The method provides a durable watertight connection between the edge metal flashing and the roofing membrane. Moreover, the proposed methods have the advantage that they can be conducted fast and efficiently, which reduces the installation costs.

Other aspects of the present invention are presented in other independent claims. Preferred embodiments of the invention are presented in the dependent claims.

BRIEF DESCRIPTION OF THE DRAWING

FIG. 1 shows a cross-section of a roof system comprising a roof substrate (1), a roofing membrane (2), an edge metal flashing (3), an adhesive layer AL (4), an epoxy resin layer EL (5) and a water impermeable liquid applied membrane M2 (6). The water impermeable liquid applied membrane M2 (6) connects an upper major surface of the edge metal flashing (3) with a portion of an upper major surface of the roofing membrane (2).

DETAILED DESCRIPTION OF THE INVENTION

The subject of the present invention is a method for connecting an edge metal flashing to a roofing membrane, the method comprising steps of:

i) Providing a roof assembly comprising a roof substrate, an edge metal flashing, and a roofing membrane, wherein a portion of the roofing membrane is trapped between the edge metal flashing and the roof substrate and wherein the roofing membrane is a water impermeable liquid applied membrane M1;

ii) applying a reactive adhesive layer AL to a portion of an upper major surface of the edge metal flashing;

iii) applying an epoxy resin layer EL on top of the reactive adhesive layer AL; and iv) applying a water impermeable liquid applied membrane M2 on top of the epoxy resin layer EL so that the applied water impermeable liquid applied membrane M2 also covers a part of the water impermeable liquid applied membrane M1.

Substance names beginning with "poly" designate substances which formally contain, per molecule, two or more of the functional groups occurring in their names. For instance, a polyol refers to a compound having at least two hydroxyl groups. A polyether refers to a compound having at least two ether groups.

The term "polymer" designates a collective of chemically uniform macromolecules produced by a polyreaction (polymerization, polyaddition, polycondensation) where the macromolecules differ with respect to their degree of polymerization, molecular weight and chain length. The term also comprises derivatives of said collective of macromolecules resulting from polyreactions, that is, compounds which are obtained by reactions such as, for example, additions or substitutions, of functional groups in predetermined macromolecules and which may be chemically uniform or chemically non-uniform.

The term "molecular weight" refers to the molar mass (g/mol) of a molecule or a part of a molecule, also referred to as "moiety". The term "average molecular weight" refers to number average molecular weight (Mn) of an oligomeric or polymeric mixture of molecules or moieties. The molecular weight may be determined by gel permeation chromatography (GPC) using polystyrene as standard, preferably using styrene-divinylbenzene gel with porosity of 100 Angstrom, 1000 Angstrom and 10000 Angstrom as columns and, depending on the molecule, tetrahydrofurane as a solvent, at 35° C., or 1,2,4-trichlorobenzene as a solvent, at 160° C.

The term "room temperature" designates a temperature of 23° C.

In this document, the term "polyurethane polymer" includes all polymers prepared by the so-called diisocyanate polyaddition process. It includes isocyanate-functional polyurethane polymers obtained by reacting polyisocyanates and polyols, which may also be called prepolymers and are polyisocyanates themselves.

One of the advantages of the claimed method is that it enables connecting in a water-tight fashion an edge metal flashing to a water impermeable liquid applied roofing membrane. This reduces the number of installation steps and potential application errors and facilitates the use of edge metal flashings in flat roof systems.

In step i) a roof assembly is provided comprising a roof substrate, an edge metal flashing, and a roofing membrane. A portion of the roofing membrane is trapped between the edge metal flashing and the roof substrate.

The roof substrate can be any conventional roof substrate, such as a concrete, metal, or wood deck.

The roof system may comprise further elements, such as films, membranes, or boards, such as vapor barriers, vapor breathers, insulation boards, or cover panels. A skilled person is familiar with these types of elements and knows where they are used in a roof system.

The edge metal flashing is preferably a L-shaped metal sheet.

Preferably, the edge metal flashing is at least partially covered with a fluoropolymer coating.

The term fluoropolymer denotes any polymer that has in its chain at least one monomer chosen from compounds containing a vinyl group capable of opening in order to be polymerized and that contains, directly attached to this vinyl group, at least one fluorine atom, at least one fluoroalkyl group or at least one fluoroalkoxy group.

Examples of fluoromonomers include, but are not limited to vinyl fluoride; vinylidene fluoride (VDF); trifluoroethylene (VF3); chlorotrifluoroethylene (CTFE); 1,2-difluoroethylene; tetrafluoroethylene (TFE); hexafluoropropylene (HFP); perfluoro (alkyl vinyl) ethers, such as perfluoro (methyl vinyl) ether (PMVE), perfluoro (ethyl vinyl) ether (PEVE) and perfluoro (propyl vinyl) ether (PPVE); perfluoro (1,3-dioxole); perfluoro (2,2-dimethyl-1,3-dioxole) (PDD).

Preferred fluoropolymers are the homopolymers and copolymers of vinylidene fluoride (PVDF). An especially preferred fluoropolymer is a homopolymer of vinylidene fluoride.

Preferably, the fluoropolymer coating is based on a composition comprising at least one polyvinylidene fluoride (PVDF) homopolymer or copolymer, preferably polyvinylidene fluoride homopolymer.

The edge metal flashing can be affixed to the roof substrate by using adhesive bonding or mechanical fastening means, such as nails or screws.

The roofing membrane is a water impermeable liquid applied membrane M1.

In step iv), a water impermeable liquid applied membrane M2 is applied on top of the reactive adhesive layer AL so that the applied water impermeable liquid applied membrane M2 also covers a part of the water impermeable liquid applied membrane M1.

In this document the term "water impermeable liquid applied membrane" preferably refers to a material which is applied in liquid form as a layer onto a substrate, and which cures to form an elastic membrane making the substrate waterproof.

Preferably, the water impermeable liquid applied membrane M1 is applied to the roof substrate by the application of a reactive composition in liquid form RC1 and letting the applied composition cure, and/or, preferably and, the water impermeable liquid applied membrane M2 is applied in step iv) in liquid form as a reactive composition in liquid form RC2.

Said reactive composition is preferably a material which is applied in liquid form as a layer onto a substrate, and which cures to form an elastic membrane making the substrate waterproof.

It if further preferred if the reactive compositions RC1 and/or, preferably and, RC2 have a water content of less than 10 wt.-%, preferably less than 5 wt. %, more preferably less than 3 wt. %, based on the total weight of the composition.

It is further preferred, if said reactive compositions RC1 and/or, preferably and, RC2 are selected from the list consisting of reactive one-part polyurethane compositions, reactive two-part polyurethane compositions and reactive two-part polyurea compositions, preferably reactive one-part polyurethane compositions.

Preferably, the reactive one-part polyurethane composition contains:

at least one isocyanate-functional polyurethane polymer; and at least one latent hardener.

The isocyanate-functional polymer is preferably liquid at room temperature.

Preferred are isocyanate-functional polymers of low viscosity, preferably with a viscosity of less than 50 Pas, more preferably less than 30 Pas, particularly less than 20 Pa·s, measured by a cone-plate-viscometer with a cone diameter of 25 mm, cone angle of 1° at a cone-plate-distance of 0.05 mm and a shear rate of 10 s−1 at 20° C.

The isocyanate-functional polymer preferably has an NCO-content in the range of 1 to 8 weight-%, preferably 1.5 to 6 weight-%.

The isocyanate-functional polymer preferably has an average molecular weight Mn in the range of 1'000 to 15'000 g/mol, preferably 1'500 to 12'000 g/mol.

The isocyanate-functional polymer is preferably obtained from the reaction of an aliphatic isocyante, preferably isophorone diisocyanate, and at least one polyol.

Preferably, the reaction is done in a molar NCO/OH ratio of at least 3/1, preferably in the range of 3/1 to 10/1, more preferably 3/1 to 8/1.

The reaction between isocyanate and the polyol is preferably conducted in the absence of moisture at a temperature in the range of 20 to 160° C., preferably 40 to 140° C., possibly in the presence of a suitable catalyst.

The polyol is preferably selected from the group consisting of polyether polyols, polyester polyols, polycarbonate polyols and polyacrylate polyols.

Preferred are polyether polyols, preferably with repetitive units selected from 1,2-ethyleneoxy, 1,2-propyleneoxy, 1,3-propyleneoxy, 1,2-butyleneoxy and 1,4-butyleneoxy. Particularly preferred are 1,2-propyleneoxy units, optionally in combination with some 1,2-ethyleneoxy units at the end of the chains. Further particularly preferred are 1,4-butyleneoxy units.

Preferred are polyetherpolyols with a content of unsaturation below 0.02 mEq/g, preferably below 0.01 mEq/g.

Preferred are polyoxypropylene diols or triols, which optionally are ethyleneoxide-endcapped, with an OH-number in the range of 10 to 250 mg KOH/g, preferably 20 to 125 mg KOH/g.

The polyol preferably has an average OH-functionality in the range of 1.7 to 3.

Particularly preferred are polyoxypropylene diols, which optionally are ethyleneoxide-endcapped, with an average molecular weight Mn in the range of 450 to 12'000 g/mol, preferably 1'000 to 6'000 g/mol.

Particularly preferred are further trimethylolpropane or glycerine started polyoxypropylene triols, which optionally are ethyleneoxide-endcapped, with an average molecular weight Mn in the range of 3'000 to 8'000 g/mol.

Particularly preferred are further poly(oxy-1,4-butylene) diols, particularly with an OH-number in the range of 50 to 180 mg KOH/g, particularly with an average molecular weight Mn in the range of 650 to 2'000 g/mol.

Preferred latent hardeners are blocked amines which have a blocked, hydrolytically activatable amino group and either at least one further blocked, hydrolytically activatable amino group or at least one reactive group R which is selected from the group consisting of hydroxyl group, mercapto group and secondary amino group.

The blocked, hydrolytically activatable amino group of the blocked amine is selected, in particular, from the group consisting of enamino groups, oxazolidino groups, ketimino groups and aldimino groups. Such blocked amines are substances known in polyurethane chemistry which are used as so-called latent hardeners in compositions containing isocyanate groups.

In the present document, "oxazolidino group" refers to both tetrahydrooxazole groups (5-ring) and tetrahydrooxazine groups (6-ring).

Preferably, the blocked, hydrolytically activatable amino group of the blocked amine is an aldimino group.

The blocked amine can be obtained, in particular, from the condensation reaction of a primary or secondary amine with a ketone or aldehyde. Particularly suitable as ketones are acetone, methyl ethyl ketone, methyl propyl ketone, methyl isopropyl ketone, methyl isobutyl ketone, methyl pentyl ketone, methyl isopentyl ketone, diethyl ketone, dipropyl ketone, diisopropyl ketone, dibutyl ketone, diisobutyl ketone, cyclopentanone, cyclohexanone and actetophen. Particularly suitable as aldehyde are formaldehyde, acetaldehyde, propanal, 2-methylpropanal, butanal, 2-methylbutanal, 2-ethylbutanal, pentanal, 2-methylpentanal, 3-methylpentanal, 4-methylpentanal, 2,3-dimethylpentanal, hexanal, 2-ethyl-hexanal, heptanal, octanal, nonanal, decanal, undecanal, 2-methyl-undecanal, dodecanal, methoxyacetaldehyde, cyclopropanecarboxaldehyde, cyclopentanecarboxaldehyde, cyclohexanecarboxaldehyde, diphenylacetaldehyde, benzaldehyde and substituted benzaldehydes.

A blocked amine having at least one oxazolidino group can be obtained in particular from the condensation reaction of at least one hydroxyamine in which the hydroxyl and primary amino groups are separated by an optionally substituted ethylene or trimethylene radical, with at least one ketone or aldehyde, in particular formaldehyde or one of the enolizable ketones or aldehydes mentioned; The aldehydes, in particular 2-methylpropanal, are particularly suitable. Particularly suitable as hydroxyamine are diethanolamine and diisopropanolamine, which lead to hydroxyoxazolidines from which polyoxazolidines can easily be prepared, for example by reaction with a polyisocyanate or a polyester.

A blocked amine having at least one ketimino or aldimino group can be obtained in particular from the condensation reaction of an amine having at least one primary amino group with at least one ketone or aldehyde, as mentioned above. If a ketone is used to block a primary amino group, a ketimino group is formed, while an aldimino group is formed when an aldehyde is used.

Most preferred, the latent hardener is a blocked amine having at least one aldimino group.

Preferably, said blocked amine is present in an amount that the ratio between the total number of aldimine groups to the total number of isocyanate groups is in the range of 0.3 to 1, preferably 0.4 to 1, more preferably 0.5 to 1.

Preferably, the reactive one-part polyurethane composition further contains fillers. Suitable fillers are ground or precipitated calcium carbonates (chalk), which are optionally surface coated with a fatty acid such as stearate, barium sulfate (barytes), slate, silicates (quartz), magnesiosilicates (talc) or alumosilicates (clay, kaolin), dolomite, mica, glass bubbles, silicic acid, particularly highly dispersed silicic acids from pyrolytic processes (fumed silica), carbon black, microspheres, pigments, particularly titanium dioxide or iron oxides, or flame-retarding fillers such as aluminium hydroxides, particularly aluminium trihydroxide (ATH), magnesium dihydroxide, antimony trioxide, antimony pentoxide, boric acid, zinc borate, zinc phosphate, melamine borate, melamine cyanurate, ethylenediamine phosphate, ammonium polyphosphate, di-melamine orthophosphate, di-melamine pyrophosphate, hexabromocyclododecane, decabromodiphenyl oxide and tris(bromoneo-pentyl) phosphate.

Preferred fillers are chalk, barytes, fumed silica and/or ATH.

Preferably, the reactive one-part polyurethane composition further contains plasticizers. Suitable plasticizers are phthalates, particularly diisononyl phthalate (DINP) or diisodecyl phthalate (DIDP), hydrogenated phthalates, particularly hydrogenated DINP, which is diisononyl-1,2-cyclohexane dicarboxylate (DINCH), terephthalates, particularly bis(2-ethylhexyl) terephthalate or diisononyl terephthalate, hydrogenated terephthalates, particularly bis(2-ethylhexyl)-1,4-cyclohexane dicarboxylate, trimellitates, adipates, particularly dioctyl adipate (DOA), azelates, sebacates, citrates, benzoates, glycol ethers, glycol esters, organic sulfonates or phosphates, particularly diphenylcresyl phosphate (DPK), polybutenes, polyisobutenes or plasticizers obtained from natural fats or oils such as epoxidized soy or linseed oil.

Preferably, the reactive one-part polyurethane composition further contains catalysts. Suitable catalysts for the acceleration of the latent hardeners, preferably aldimine hydrolysis, are acid catalysts, particularly carboxylic acids or sulfonic acids, preferably aromatic carboxylic acids such as benzoic acid or salicylic acid.

Suitable catalysts are catalysts for the acceleration of the reaction of isocyanate groups, particularly metal catalysts, preferably dialkyltin complexes, in particular dibutyltin or dioctyltin carboxylates or acetoacetonates such as dibutyltindilaurate (DBTDL), dibutyltindi (acetoacetate) (DBT (acac) 2) or dioctyltindilaurate (DOTDL), or amine catalysts, preferably tertiary aminoethers, in particular 2,2'-dimorpholinodiethylether (DMDEE).

Preferably, the reactive one-part polyurethane composition further contains additives selected from the group consisting of UV stabilizers, wetting agents, flow enhancers, leveling agents, defoamers, deaerating agents and biocides.

Preferably, the reactive compositions RC1 and/or, preferably and, RC2 are reactive one-part polyurethane composition containing:

- an amount of isocyanate-functional polymers in the range of 15 to 80 weight-%, particularly 20 to 50 weight-%, in relation to the total composition; and
- an amount of latent hardener, preferably aldimines, in the range of 0.5 to 25 weight-%, preferably 1 to 20 weight-%, in relation to the total composition; and
- an amount of plasticizers in the range of 0 to 40 weight-%, preferably 10 to 30 weight-%, in relation to the total composition; and
- an amount of fillers in the range of 0 to 80 weight-%, preferably 20 to 60 weight-%, in relation to the total composition, preferably, the filler contains at least one flame-retarding ingredient, more preferably aluminium trihydroxide (ATH).

The reactive one-part polyurethane composition is preferably formulated as a single-pack composition, prepared by mixing all ingredients under exclusion of moisture to obtain a macroscopically homogeneous fluid or paste and stored in a moisture-tight container at ambient temperatures. A suitable moisture-tight container consists preferably of an optionally coated metal or plastic. It is preferably a bucket, a barrel, a hobbock, a bag, a sausage, a cartridge, a can, a bottle or a tube.

The process of curing begins when the reactive one-part polyurethane composition is applied and gets in contact with moisture, especially atmospheric moisture. Upon curing, the isocyanate groups react under the influence of moisture with the hydrolyzing latent groups of the latent hardener, preferably hydrolyzing aldimine groups. Further, isocyanate groups react with each other under the influence of moisture. As a result of these reactions, the composition cures to form an elastic material.

The reactive one-part polyurethane composition is preferably applied at ambient conditions, preferably in a temperature range of −10 to 50° C., more preferably −5 to 45° C., particularly 0 to 40° C. The curing of the composition preferably also takes place at ambient conditions.

The reactive one-part polyurethane composition preferably has a sufficient open time to allow precise positioning and large surface applications and a fast-curing progress, whereby the composition soon becomes tack-free and shows a fast build-up of mechanical strength and elasticity.

"Open time" is the time period, within which the applied composition can be processed or reworked without any negative effect. It is over when the viscosity of the composition due to progressing curing has risen too much, at the latest when a skin is formed on the surface. The time period, until a skin is formed on the surface, is called "skin formation time" or "skinning time".

It is further preferred if the water impermeable liquid applied membrane M1 and/or, preferably and, the water impermeable liquid applied membrane M2 comprise a fibre reinforcement mesh, preferably a non-woven polyester fibre mesh or a non-woven glass fibre mesh, preferably the fibre reinforcement mesh was worked into the reactive composition RC1, RC2 respectively, as long as the composition was still liquid.

The thickness of the water impermeable liquid applied membrane M1 is preferably in the range of 0.5-5 mm, preferably 1.0-3.5 mm, more preferably 1.5-3 mm.

In step ii), a reactive adhesive layer AL is applied to a portion of an upper major surface of the edge metal flashing. Preferably, the reactive adhesive layer AL is applied to the upper surface of the edge metal flashing that is facing away from the water impermeable liquid applied membrane M1 and covers more than 30%, preferably more than 40% more preferably more than 50% of said surface. It is further preferred if the reactive adhesive layer AL covers said surface of the edge metal flashing over a length of more than 5 cm, preferably more than 7.5 cm, more preferably more than 10 cm.

The reactive adhesive can be applied on top of the upper major surface of the edge metal flashing by using any conventional techniques, for example, by means of a roller, brush, or by pouring-out and further distributed by means, for example, of a roller, a scraper, or a notched trowel.

The reactive adhesive layer AL formed by the reactive adhesive preferably has a thickness of 0.25-5 mm, more preferably 0.5-4 mm. Such a thickness of the reactive adhesive layer AL has been found to provide sufficiently high peel strengths between the edge metal flashing and the applied epoxy resin layer EL.

Suitable reactive adhesives include one- and two-component epoxide, acrylic, and polyurethane adhesives. The adhesives can be one-component reactive adhesives, where all constituents are packed in one single component/package or multi-component adhesives, particularly two-component adhesives, where the constituents of the adhesive are provided two or more separately stored packages or compartments of a single package. At the time of use, the components of a multiple-component adhesive are mixed with each other to provide a reactive adhesive composition having a specified open time.

Suitable reactive adhesives are commercially available, for example, under the trade name of SikaDur® and SikaFast®, such as SikaDur® 31 HiMod, and SikaFast® 3341.

Preferably, the reactive adhesive is selected from one- and two-component epoxide, acrylic, and polyurethane adhesives, preferably acrylic adhesives.

The term "acrylic adhesive" designates in the present disclosure adhesive compositions containing one or more acrylic polymers as the main polymer component, wherein the term "acrylic polymer" designates homopolymers, copolymers and higher inter-polymers of an acrylic monomer with one or more further acrylic monomers and/or with one or more other ethylenically unsaturated monomers.

The term "monomer" refers to a compound that chemically bonds to other molecules, including other monomers, to form a polymer. The term "acrylic monomer" refers to monomers having at least one (meth)acryloyl group in the molecule. The term "(meth)acryloyl" designates methacryloyl or acryloyl. Accordingly, the term "(meth)acrylic" designates methacrylic or acrylic. A (meth)acryloyl group is also known as (meth)acryl group.

In step iii), an epoxy resin layer EL is applied on top of the reactive adhesive layer AL.

Preferably, the epoxy resin layer EL covers more than 60%, preferably more than 80%, more preferably more than 90% of the surface of the reactive adhesive layer AL.

The epoxy resin layer EL can be applied on top of the surface of the reactive adhesive layer AL by using any conventional techniques, for example, by means of a roller, brush, or by pouring-out and further distributed by means, for example, of a roller, a scraper, or a notched trowel.

Preferably, the epoxy resin layer EL has a thickness thinner than 1 mm, particularly 1-500 μm, preferably 1-300 μm.

Preferably, the epoxy resin composition used for the epoxy resin layer EL comprises:

at least one liquid epoxy resin LER; and at least one amine hardener AH.

Preferred one liquid epoxy resin LER are in particular aromatic epoxy resins, especially the glycidyl ethers of:

- bisphenol A, bisphenol F or bisphenol A/F, where A stands for acetone and F for formaldehyde, which served as reactants for the preparation of these bisphenols. In the case of bisphenol F, positional isomers may also be present, especially derived from 2,4'- or 2,2'-hydroxyphenylmethane.
- dihydroxybenzene derivatives such as resorcinol, hydroquinone or catechol;
- further bisphenols or polyphenols such as bis(4-hydroxy-3-methylphenyl) methane, 2,2-bis(4-hydroxy-3-methylphenyl) propane (bisphenol C), bis(3,5-dimethyl-4-hydroxyphenyl) methane, 2,2-bis(3,5-dimethyl-4-hydroxyphenyl) propane, 2,2-bis(3,5-dibromo-4-hydroxyphenyl) propane, 2,2-bis(4-hydroxy-3-tert-butylphenyl) propane, 2,2-bis(4-hydroxyphenyl) butane (bisphenol B), 3,3-bis(4-hydroxyphenyl) pentane, 3,4-bis(4-hydroxyphenyl) hexane, 4,4-bis(4-hydroxyphenyl) heptane, 2,4-bis(4-hydroxyphenyl)-2-methylbutane, 2,4-bis(3,5-dimethyl-4-hydroxyphenyl)-2-methylbutane, 1,1-bis(4-hydroxyphenyl) cyclohexane (bisphenol Z), 1,1-bis(4-hydroxyphenyl)-3,3,5-trimethylcyclohexane (bisphenol TMC), 1,1-bis (4-hydroxyphenyl)-1-phenylethane, 1,4-bis[2-(4-hydroxyphenyl)-2-propyl]benzene (bisphenol P), 1,3-bis[2-(4-hydroxyphenyl)-2-propyl]benzene (bisphenol M), 4,4'-dihydroxydiphenyl (DOD), 4,4'-dihydroxybenzophenone, bis(2-hydroxynaphth-1-yl) methane, bis(4-hydroxynaphth-1-yl) methane, 1,5-dihydroxynaphthalene, tris(4-hydroxyphenyl) methane, 1,1,2,2-tetrakis(4-hydroxyphenyl) ethane, bis(4-hydroxyphenyl) ether or bis(4-hydroxyphenyl) sulfone;
- condensation products of phenols with formaldehyde that are obtained under acidic conditions, such as phenol novolaks or cresol novolaks, also called bisphenol F novolaks;
- aromatic amines such as aniline, toluidine, 4-aminophenol, 4,4'-methylenediphenyldiamine, 4,4'-methylenediphenyldi(N-methyl)amine, 4,4'-[1,4-phenylenebis(1-methylethylidene)]bisaniline (bisaniline P) or 4,4'-[1,3-phenylenebis(1-methylethylidene)]bisaniline (bisaniline M).

A preferred liquid epoxy resin is a liquid resin based on a bisphenol, in particular a bisphenol A diglycidyl ether and/or bisphenol F diglycidyl ether, as are commercially available, for example, from Dow, Huntsman or Momentive. These liquid resins have a viscosity that is low for epoxy resins and good properties as a coating when cured. They may contain proportions of solid bisphenol A resin or novolak glycidyl ethers.

Preferred amine hardener AH are selected from the list consisting of:

- aliphatic, cycloaliphatic or arylaliphatic primary di- or triamines, especially isophorone diamine (IPD) and m-xylylenediamine (MXDA),
- ether group-containing aliphatic primary di- or triamines,
- polyamines containing secondary amino groups, preferably 2-piperazin-1-ylethylamine, and
- adducts of these amines with epoxides or epoxy resins, in particular adducts with diepoxides or monoepoxides.

More preferred, the amine hardener AH consists of a mixture of said list.

Most preferred, the amine hardener AH consists of a mixture of:

aliphatic, cycloaliphatic or arylaliphatic primary di- or triamines, especially isophorone diamine (IPD) and m-xylylenediamine (MXDA), and polyamines containing secondary amino groups, preferably 2-piperazin-1-ylethylamine.

Preferably, the epoxy resin composition has a water content of less than 5 wt.-%, preferably less than 3 wt. %, based on the total weight of the composition.

Preferably, the epoxy resin composition has, 2 minute after mixing all the components, a viscosity of less than 15'000 cP, preferably less than 12'500 cP, more preferably less than 10'000 cP, using a Brookfield DV1 Viscometer with a HB-04 spindle @ 100 rpms at 23° C.

In step iv), a water impermeable liquid applied membrane M2 is applied on top of the epoxy resin layer EL so that the applied water impermeable liquid applied membrane M2 also covers a part of the water impermeable liquid applied membrane M1. Preferably, the applied water impermeable liquid applied membrane M2 covers the water impermeable liquid applied membrane M1 over a length of 10 to 50 cm, preferably 15 to 40 cm, more preferably 20 to 30 cm.

It is further preferred if the applied water impermeable liquid applied membrane M2 covers more than 60%, preferably more than 80%, more preferably more than 90% of the surface of the epoxy resin layer EL.

The thickness of the water impermeable liquid applied membrane M2 is preferably in the range of 0.5-5 mm, preferably 1.0-3.5 mm, more preferably 1.5-3 mm.

Another aspect of the present invention is a roof system comprising:

A roof substrate (1);

a roofing membrane (2) covering at least a portion of an upper major surface of the roof substrate (1);

an edge metal flashing (3), wherein a portion of the roofing membrane (2) is trapped between the edge metal flashing (3) and the roof substrate (1);

wherein the roofing membrane is a water impermeable liquid applied membrane M1.

On a portion of an upper major surface of the edge metal flashing (3) a reactive adhesive layer AL (4) is applied, and on top of said a reactive adhesive layer AL (4) an epoxy resin layer EL (5) is applied.

A water impermeable liquid applied membrane M2 (6) is applied on top of said epoxy resin layer EL (5) so that the applied water impermeable liquid applied membrane M2 (6) also covers a part of the roofing membrane (2).

Preferably, the roofing membrane (2) covers more than 80%, preferably more than 90%, more preferably all of the upper major surface of the roof substrate (1).

Preferred embodiments of the roof substrate, water impermeable liquid applied membrane M1, water impermeable liquid applied membrane M2, edge metal flashing, epoxy resin layer EL and reactive adhesive layer AL have already been discussed above.

Experiments

A reactive acrylic adhesive (SikaFast® 3341) was applied to a clean and dry Kynar painted metal sheet, with the help of a notched trowel and a flat putty knife at a thickness of 2 mm and allowed to cure for 4 hours. Afterwards, the A-part and B-component of Sikalastic® EP Primer/Sealer were mixed for 3 minutes by drill and appropriate mixing paddle to achieve a uniform mixture. Said mixture was applied to the cured Sikafast®3341 and while wet, precut lengths of Sika Flexitape Heavy (polyamide reinforcement fabric, 1" wide) were embedded into the wet Sikalastic@ EP Primer/Sealer so that a parts of the fabric were overlapping. This was allowed to cure for 72 hours. Using said setup a peel adhesion test was performed on the overlapping fabric. Peel adhesion results exceeded 8 pli (pounds per linear inch). The sample was then immersed in water for 2 weeks and peel adhesion testinging was conducted. Results again exceeded 8 pli.

In contrast, applying a Sikalastic@ EP Primer layer directly on the Kynar painted metal sheet and while wet, embedding precut lengths of Sika Flexitape Heavy (polyamide reinforcement fabric, 1" wide) into the wet Sikalastic@ EP Primer/Sealer, did not provide sufficient adhesion. The peel adhesion results did not exceed 8 pli (pounds per linear inch) and showed much lower values.

The same was found for applying SikaFast® 3341 directly on the Kynar painted metal sheet and while wet, embedding precut lengths of Sika Flexitape Heavy (polyamide reinforcement fabric, 1" wide) into the wet SikaFast® 3341. Also, the peel adhesion results did not exceed 8 pli (pounds per linear inch) and showed much lower values.

The invention claimed is:

1. A method for connecting an edge metal flashing to a roofing membrane, the method comprising steps of:

i) providing a roof assembly comprising a roof substrate, an edge metal flashing, and a roofing membrane, wherein a portion of the roofing membrane is trapped between the edge metal flashing and the roof substrate and wherein the roofing membrane is a water impermeable liquid applied membrane;

ii) applying a reactive adhesive layer to a portion of an upper major surface of the edge metal flashing;

iii) applying an epoxy resin layer on top of the reactive adhesive layer; and iv) applying a water impermeable liquid applied membrane on top of the epoxy resin layer so that the applied water impermeable liquid applied membrane also covers a part of the water impermeable liquid applied membrane, wherein applying the water impermeable liquid applied membrane comprises at least one of (i) the water impermeable liquid applied membrane is applied to the roof substrate by an application of a first reactive composition in liquid form and letting the applied composition cure, or (ii) the water impermeable liquid applied membrane is applied in liquid form as a second reactive composition in liquid form, wherein at least one of the first and second reactive compositions are selected from the group consisting of reactive one-part polyurethane compositions, reactive two-part polyurethane compositions, and reactive two-part polyurea compositions, wherein at least one of the first and second reactive compositions is a reactive one-part polyurethane composition containing:

an amount of isocyanate-functional polymers in a range of 15 to 80 weight-% in relation to a total composition; and an amount of latent hardener in a range of 0.5 to 25 weight-% in relation to the total composition; and an amount of plasticizers in a range of 0 to 40 weight-% in relation to the total composition; and an amount of fillers in a range of 0 to 80 weight-% in relation to the total composition.

2. The method according to claim 1, wherein the first and second reactive compositions have a water content of less than 10 wt.-%, based on a total weight of the composition.

3. The method according to claim 1, wherein the water impermeable liquid applied membrane and/or the water impermeable liquid applied membrane comprise a fibre reinforcement mesh.

4. The method according to claim 1, wherein the reactive adhesive is selected from epoxide, acrylic, and polyurethane adhesives, and wherein the reactive adhesive is selected from a single-component adhesive or a two-component adhesive.

5. The method according to claim 1, wherein an epoxy resin composition used for the epoxy resin layer comprises:

at least one liquid epoxy resin; and at least one amine hardener.

6. The method according to claim 1, wherein the edge metal flashing is at least partially covered with a fluoropolymer coating.

7. The method according to claim 6, wherein the fluoropolymer coating is based on a composition comprising at least one polyvinylidene fluoride (PVDF) homopolymer or copolymer.

* * * * *